United States Patent [19]

Aihara et al.

[11] Patent Number: 4,938,710

[45] Date of Patent: Jul. 3, 1990

[54] CONNECTOR APPARATUS

[75] Inventors: Yasuyuki Aihara; Hideki Kano; Yoshikazu Tsuchiya; Noboru Miyazaki, all of Tochigi, Japan

[73] Assignee: Honda Giken Kogyo Kabushiki Kaisha, Tokyo, Japan

[21] Appl. No.: 284,986

[22] Filed: Dec. 15, 1988

[30] Foreign Application Priority Data

Dec. 15, 1987 [JP] Japan ..... 62-189392[U]

[51] Int. Cl.[5] ..... H01R 4/50

[52] U.S. Cl. ..... 439/345; 439/533; 439/357

[58] Field of Search ..... 439/34, 350, 351, 352, 439/353, 354, 355, 356, 357, 358, 345, 369, 488, 489, 491, 527, 529, 533

[56] References Cited

U.S. PATENT DOCUMENTS

| | | | |
|---|---|---|---|
| 1,989,823 | 2/1935 | Raabe | 439/369 |
| 3,132,412 | 5/1964 | Friedman | 439/533 X |
| 3,383,639 | 4/1966 | Anderson et al. | 439/369 |
| 3,484,736 | 1/1967 | Wyse | 439/369 X |
| 4,634,204 | 1/1987 | Detter | 439/358 |
| 4,708,413 | 11/1987 | Schroeder | 439/358 |
| 4,741,590 | 5/1988 | Caron | 439/369 X |
| 4,746,306 | 5/1988 | Yurtin et al. | 439/357 |

FOREIGN PATENT DOCUMENTS

| | | | |
|---|---|---|---|
| 0988486 | 5/1976 | Canada | 439/527 |

*Primary Examiner*—Neil Abrams
*Assistant Examiner*—Khiem Nguyen
*Attorney, Agent, or Firm*—Lyon & Lyon

[57] ABSTRACT

A connector apparatus for electrical wiring with male and female connector members and a stay for mounting the connector members on a base, such as a vehicle. The connector members are provided with mating male and female projections, one of which has an engagement opening for receiving a locking pawl on the stay when the connector members are completely and properly assembled. The engagement opening is partially blocked if the connector members are not completely and properly assembled and the pawl is tapered to force such assembly upon installation of the connector members on the stay.

8 Claims, 1 Drawing Sheet

CONNECTOR APPARATUS

BACKGROUND OF THE INVENTION

This invention relates to a connector apparatus primarily for use in vehicle wiring systems and male and female connector members and a stay for mounting the connector in place.

There has been known from the Japanese Utility Model Registration Application publication Sho 62-15783 a connector of this type wherein a locking pin is attached by insertion through one side wall of the housing of the female connector member in such a manner that the pin is slidable and urged outwards by a spring. The locking pin extends across the interior of the housing so as to be able to be screwed into a tapped hole provided in the other side wall of said housing. The male connector member is provided with a through-hole located to be aligned with the holes in the female connector member when assembled to receive the locking pin so that the connector members are locked together when the locking pin is pushed through the through-hole into the tapped hole and screwed thereinto.

In the case of the above-mentioned connector, if the two connector members are not properly fitted into each other, the locking pin does not align with the through-hole so that the locking pin cannot be pushed therethrough, which indicates that the two connector members are not properly fitted into each other. While this may seem to be an advantage, this conventional connector has some disadvantages including that it needs more separate parts, such as the locking pin and the spring, that it takes more time and labor to lock it in place because the locking pin has to be screwed into the tapped hole for locking, and that since the through-hole in the male connector member is in the main body portion there is less design freedom with respect to the layout of the electrical terminals in the main body portion.

A conventional connector used for wiring in a vehicle is usually mounted on the vehicle body by means of a stay. Therefore, it is an object of the present invention to provide a connector apparatus in which the stay is so designed as to concurrently serve also as a device for locking the two connector members together when they are properly assembled, thereby solving the foregoing problems of the prior art.

SUMMARY OF THE INVENTION

In order to achieve the aforementioned objective, the present invention provides a connector apparatus comprising male and female connector members and a stay for mounting the connector in place, wherein a male projection is provided on an outer side surface of the housing of the male connector member, a female projection is provided on an outer side surface of the female connector member into which said male projection is inserted when the male and female connector members are assembled, and at least one of the male and the female projections has an engagement opening formed to open in a direction perpendicular to the direction for assembling connector members so that a portion of said engagement opening is narrowed by the other projection during assembly and is wide-open upon complete assembly for receiving a locking pawl formed on the stay. With this arrangement, the locking pawl prevents the male and the female projections from moving the disassembling direction that causes a reduction or narrowing of the engagement opening and thus holds the two connector members locked in the properly assembled condition on the stay. If the two connector members are in a partially assembled condition, an insufficient opening of the engagement opening makes it difficult to insert the locking pawl. This can be used to determine whether or not the two connector members are properly assembled. In addition, each of the projections is provided on an outer side surface of the housing of each connector member, whereby locking mechanism does not interfere with the layout of the electrical terminals in the connector members.

Preferred embodiment examples of the present invention will now be explained with reference to the accompanying drawings, wherein:

DETAILED DESCRIPTION

Figure 1:
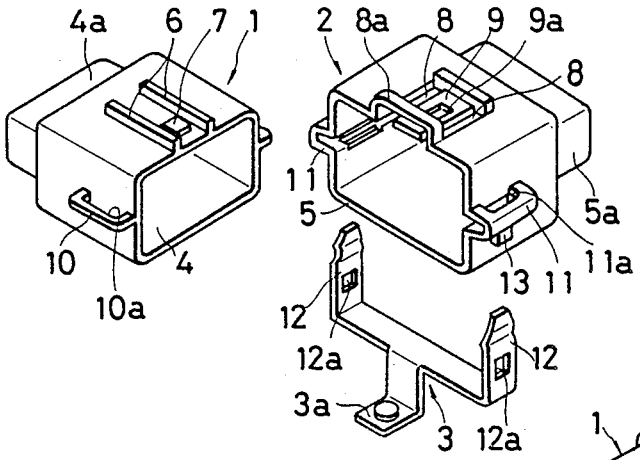
FIG. 1 is an exploded perspective view of a connector apparatus according to the present invention.

Referring to FIG. 1, there is shown a male connector member 1, a female connector member 2, and a connector-mounting stay 3 having a portion 3*a* that will be mounted on a base, such as a vehicle body. The connector members 1 and 2 each comprise a box-shaped housing 4 and 5, respectively, having on its rear end a terminal block portion 4*a* and 5*a*, respectively, in which are housed a number of electrical terminals (not shown). On the top wall portion of the housing 4 of the male connector member 1 a pair of right and left ridges 6 and 6 are provided and an intermediate projection 7 is located therebetween. On the top wall portion of the housing 5 of the female connector member 2 a pair of slits 8 and 8 are provided to receive the ridges 6 and 6 and a tongue piece 9 is located between the slits 8 and 8. When the male connector member 1 is inserted into the female connector member 2, the intermediate projection 7 becomes engaged with an engagement hole 9provided in the tongue piece 9 so as to lock the two connector members securely in place and prevent them from slipping out of position. An arch-shaped stopper 8*a* is formed to span the tongue piece 9 at the front edge of the top wall portion of the housing 5 for preventing the tongue piece from moving upwards out of position and is usually completely effective, but when the connector is mounted on a vehicle or the like the intermediate projection 7 sometimes becomes disengaged from the engagement hole 9*a* due to vibrations and movements of the vehicle.

Furthermore, when an assembly worker mounts the connector apparatus it can happen that, in the vehicle he may not notice that the two connector members 1 and 2 are still in only a partially assembled condition in which the projection 7 is not engaged with the engagement hole 9*a*. Thus, the foregoing arrangement alone is not enough to completely avoid an improper fitting of the connector members.

In view of the foregoing problems, a connector apparatus according to the above embodiment example of the present invention also is provided on each of the outer surfaces of both the left and right side walls of the housing 4 of the male connector member 1 with a male projection 10 formed to extend in the longitudinal or front-to-rear direction in which the two connector members 1 and 2 are fitted in to each other. There is also provided on each of the outer surfaces of both the left and right side walls of the housing 5 of the female connector member 2 a female projection 11 so formed as to permit the male projection 10 to be inserted thereinto in the front-to-rear direction. The projections 10 and 11 each have an engagement opening 10*a* and 11*a*, respectively, formed to open in the vertical direction so that an overlapped opening of the two engagement openings 10*a* and a increases as the two connector members 1 and 2 are being assembled. A pair of locking pawls 12 and 12 are formed on the stay 3 for receiving the housing 5 of the female connector member 2 horizontally therebetween. Each locking pawl 12 is of a size and shape to be inserted fully through the overlapped opening of the two engagement openings 10*a*and 11*a* when the two connector members 1 and 2 are properly assembled.

Figure 2:
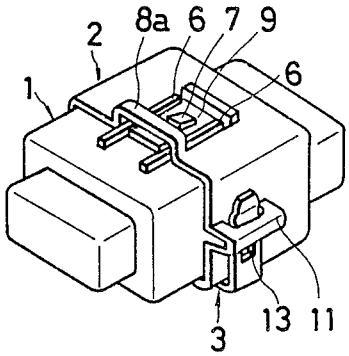
FIG. 2 is a perspective view of the connector apparatus of FIG. 1 completely assembled.

The stay 3 is mounted to the vehicle body in advance. The assembled connector members 1 and 2 are mounted on the stay 3 by fitting the overlapped opening of the engagement openings 10*a*and 11*a* on the left side thereof and that on the right side thereof onto the corresponding locking pawls 12 and 12 and then pushing in the connector onto the two locking pawls 12 and 12. If the connector members 1 and 2 are properly and completely assembled to each other, each locking pawl 12 will be inserted through each overlapped opening of the engagement openings 10*a* and 11*a* on the left and right sides whereby the male and the female projections 10 and 11 are securely locked together by the locking pawl 12, as shown in FIG. 2, so that the connector members 1 and 2 are held locked in the properly assembled condition on the stay 3.

The locking pawls 12 and 12 shown in the drawings each have a wedgeshaped, top-end portion tapering toward the tip thereof so that both the connector members 1 and 2 may be forcibly brought into the proper and complete assembled condition by forcibly inserting the wedge-shaped, top-end portion of the locking pawls 12 and 12 into an overlapped opening of the engagement openings 10*a* and 11*a* even when they are not completely assembled to each other before installation on the stay 3.

In addition, there is also provided on each side wall of the housing 5 of the female connector member 2 an engaging projection 13 located immediately below the female projection 11 so that the engaging projection 13 may be engaged with a locking hole 12*a* formed in the locking pawl 12 when the locking pawl 12 is inserted through the overlapped opening of the engagement openings 10*a* and 11*a*. This keeps the connector securely locked to the stay 3.

Figure 3:
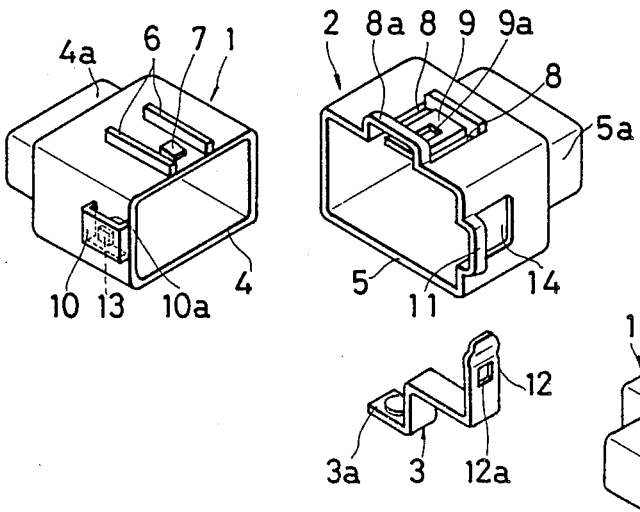
FIG. 3 is an exploded perspective view of a modified form of a connector apparatus of this invention.
Figure 4:
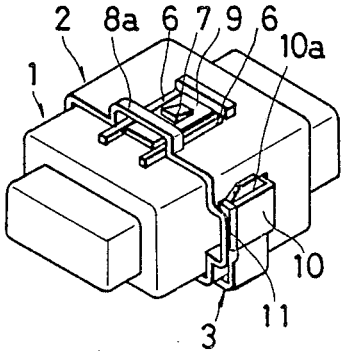
FIG. 4 is a perspective view of the modified form of FIG. 3 completely assembled.

In the foregoing embodiment, both the male and the female projections 10 and 11 are so formed as to have respectively the engagement openings 10*a* and 11*a*.One of other possible embodiments of the present invention is shown in FIGS. 3 and 4, in which the male projection 10 is provided with only one engagement opening 10*a* while there is provided in the side wall of the housing 5 of the female connector member 2 only one cutout portion 14 to receive the male projection 10. The cutout portion is formed at its front edge with an arch-shaped portion of the female projection 11. According to this arrangement, the engagement opening 10*a* of the male projection 10 that is inserted through the arch-shaped portion of the female projection 11 into the cutout portion 14 is sized to be wide enough to allow the locking pawl 12 to be inserted therethrough only when the connector members 1 and 2 are properly and completely assembled to each other. In this embodiment, the projections 10 and 11 are formed only on one side wall of each of the housings 4 and 5 of the connector members 1 and 2 so that the connector is supported only from one side on the stay 3. In order to securely lock the connector to the stay 3 and prevent it from slipping out of position with respect to the stay 3, there is provided on an inner wall of the engagement opening 10*a* an engaging projection 13 so formed as to fit in the locking hole 12*a* of the locking pawl 12 when the connector members 1 and 2 are properly assembled.

Although in the above embodiments the stay 3 is shown and described as a separate part not integral with the mounting base plate of the vehicle body, it can be constructed so as to be integral with the mounting base plate.

As described in the foregoing, the connector apparatus according to the present invention is such that the male and the female connector members are locked in the properly assembled condition by means of the locking pawl formed integrally with the connector-mounting stay, thus making it unnecessary to provide a separate locking member such as a locking pin. This contributes to cost reduction through reduction in the number of parts and at the same time facilitates the assembly work in that both the male and the female connector members become properly assembled to each other and locked in that condition simultaneously when the connector is mounted onto the stay. Another advantage is that it does not interfere with design freedom with respect to the layout of the terminals to be housed in the connector members.

We claim:

1. A connector apparatus comprising male and female connector members each having a housing, a stay for mounting the connector members in place, a male projection provided on an outer side surface of the housing of the male connector member, a female projection into which said male projection can be inserted in the direction in which both the male and the female connector members are assembled to each other provided on an outer side surface of the housing of the female connector member, and at least one of the male and the female projections has an engagement opening formed to open in a direction perpendicular to said assembly direction of the male and the female connector members so that an opening of said engagement opening becomes narrower depending on the progress in assembling the male and the female connector members and becomes wide-open to receive a locking pawl formed on the stay when both the male and the female connector members are completely assembled to each other, said locking pawl having a wedge-shaped end so that it can be inserted into the engagement opening by forcible insertion even when both the male and the female connector members are still in a partially assembled condition, thereby forcibly brining the connector members into the completely assembled condition; wherein a said male projection is provided on each of two opposite outer side surfaces of the male connector member housing, wherein a said female projection is provided on each of two opposite outer side surfaces of the female connector member housing, and the stay comprises two locking pawls for inserting into two engagement openings formed on said projections.

2. A connector apparatus according to claim 1, wherein there is provided on an outer side surface of the housing of the male connector member or that of the female connector member an engaging projection so formed as to fit in a locking hole formed in the locking pawl when the locking pawl is inserted into the engagement opening.

3. A connector apparatus according to claim 1, wherein a separate engaging projection is provided on an outer top surface of the male connector member housing, and a tongue piece is provided on an outer top surface of the female connector member housing, said tongue piece having a hole for engaging said separate engaging projection when the male and female connector members are completely assembled for inhibiting inadvertent disassembly.

4. A connector apparatus comprising male and female connector members each having a housing, a stay for mounting the connector members in place, a male projection provided on each of two opposite outer side surfaces of the male connector member housing, a female projection provided on each of two opposite outer side surfaces of the female connector member housing, said female projections formed for insertion of said male projections in the direction in which the male and the female connector members are assembled to each other, and at least one of the male and the female projections of each mating pair of male and female projections has an engagement opening formed to open in a direction perpendicular to said assembly direction of the male and the female connector members so that an opening of said engagement opening becomes narrower depending on the progress in assembling the male and the female connector members and becomes wide-open to receive a locking pawl formed on the stay when both the male and the female connector members are completely assembled to each other, and the stay comprises two locking pawls for inserting into two engagement openings formed on said projections.

5. A connector apparatus according to claim 4, wherein there is provided on an outer side surface of the housing of the male connector member or that of the female connector member an engaging projection so formed as to fit in a locking hole formed in the locking pawl when the locking pawl is inserted into the engagement opening.

6. A connector apparatus comprising a male connector member, a female connector member for receiving said male connector member, a stay for mounting the connector members, said connector members having mating means thereon, on said mating means having an engagement opening that is fully open in a completely assembled condition of said connector members and is only partially open in a less than completely assembled condition of said connector members by reason of interference with said engagement opening by the other said mating means, and locking means on said stay for inserting into said engagement opening in the completely assembled condition of said connector members to maintain said completely assembled condition, said locking means having a wedge-shaped end portion for insertion into the engagement opening with force even when both the male and female connector members are still in a partially assembled condition, thereby forcibly bringing the connector members in the completely assembled condition; wherein a said mating means is provided on each of two opposite outer side surfaces of the male connector member, and the stay comprised two locking means for inserting into two engagement openings formed on said mating means.

7. A connector apparatus according to claim 6, wherein there is provided on an outer side surface of the housing of the male connector member or that of the female connector member an engaging projection so formed as to fit in a locking hole formed in the locking means when the locking means is inserted into the engagement opening.

8. A connector apparatus according to claim 6, wherein a separate engaging projection is provided on an outer top surface of the male connector member, and a tongue piece is provided on an outer top surface of the female connector member, said tongue piece having a hole for engaging said separate engaging projection when the male and female connector members are completely assembled for inhibiting inadvertent disassembly.

* * * * *